United States Patent [19]

Fremion

[11] 4,202,485

[45] May 13, 1980

[54] CONTAINER AND BLANK THEREFOR

[75] Inventor: Edwin A. Fremion, West Alexandria, Ohio

[73] Assignee: Dyna Con Packaging Inc., Hamilton, Ohio

[21] Appl. No.: 914,148

[22] Filed: Jun. 9, 1978

[51] Int. Cl.[2] ..... B65D 5/10

[52] U.S. Cl. ..... 229/22; 206/395; 225/48; 229/37 R

[58] Field of Search ..... 229/8, 22, 37 R; 225/48, 49; 206/395

[56] References Cited

U.S. PATENT DOCUMENTS

| | | | |
|---|---|---|---|
| 1,221,785 | 4/1917 | Williams | 229/22 X |
| 1,833,419 | 11/1931 | Grossen | 229/22 |
| 1,897,143 | 2/1933 | Powell | 229/22 |
| 2,227,341 | 12/1940 | Greenwood | 229/22 |
| 2,334,997 | 11/1943 | Doll | 229/22 X |
| 2,507,403 | 5/1950 | Gluck | 206/395 |
| 2,985,353 | 5/1961 | Force | 229/22 |
| 3,199,764 | 8/1965 | Locke | 229/22 X |
| 3,244,348 | 4/1966 | Shaw | 229/22 |
| 3,482,760 | 12/1969 | Pascus et al. | 229/22 |
| 3,653,576 | 4/1972 | Stranicky | 229/22 |
| 3,891,136 | 6/1975 | Woeste | 229/22 |

FOREIGN PATENT DOCUMENTS

| | | | |
|---|---|---|---|
| 832724 | 4/1960 | United Kingdom | 229/8 |
| 1320821 | 6/1973 | United Kingdom . | |

*Primary Examiner*—Stephen P. Garbe

*Attorney, Agent, or Firm*—Biebel, French & Nauman

[57] ABSTRACT

A single rectangular blank (10) folds easily into a strong and rigid triangular container (15) with no wasted material. The blank may be cut and creased with a single die. The erected container in cross-section may be isosceles or equilateral, according to its contents.

18 Claims, 14 Drawing Figures

CONTAINER AND BLANK THEREFOR

BACKGROUND OF THE INVENTION

This invention relates to containers, such as shipping containers, for articles having relatively simple shapes. Hundreds of thousands of products such as candles, shock absorbers, flowers, rolls of sheet material, tubes of toothpaste, and so on, are shipped daily, and must be protected from damage. If destined for retail sale, the package should also be attractive and suitable for use at point-of-sale. Yet due to the volume in which many of these products are produced, it is essential that package costs be kept to a minimum.

Some of the costs of a package may not be immediately obvious. Obvious costs, for example, are the sheet material for the package, cutting and creasing the sheet, and folding and erecting the package. However, the cost for the package blank must include the waste material which is discarded when the package is first cut out. A complicated package is also more difficult and time consuming to assemble than a simple one. In addition to these are costs which might be considered hidden, such as strength penalties due to inferior package shape, which then requires heavier material to protect the package contents. To a retailer, another hidden cost would be a package unsuitable for point-of-sale display, thus calling for manual handling and a special display unit.

There is thus a continuing need for containers which provide a maximum amount of strength with the minimum amount of material, which minimize or eliminate wasted material, and which are easy to erect. Such packages should also be versatile, attractive, and convenient for use in a broad range of applications, and should minimize all costs, both apparent and hidden.

SUMMARY OF THE INVENTION

Briefly, the present invention meets the above needs with an extremely strong triangular or wedge-shaped container which can be formed with no waste material from a single rectangular or square blank of sheet material. The blank has three rectangular panels and a fastener, such as a fastening flap, connected to one another by fold lines. Two of the panels also have chevron fold lines at their ends which form triangular end panels for the container. As the blank is folded, the triangular end panels fold inwardly to close the ends of the container, and the fastening flap is secured to the panel opposite it on the blank. This results in a sturdy, secure, and rugged container which is easily assembled and which provides maximum protection for the product it contains.

It is therefore an object of the present invention to provide a triangular container which is formed from a single blank of material; which can be fabricated with no wasted material; which is readily folded and erected; which includes three panels and a fastener connected by fold lines, and two pairs of triangular end panels formed in the ends of two of the adjacent outer panels by chevron fold lines, the triangular panels closing the ends of the container when erected; which may readily be modified for such purposes as display and dispensing; and to accomplish the above objects and purposes in an uncomplicated, inexpensive, strong and versatile configuration readily suited for packaging and shipping a wide variety of products safely and securely.

Other objects and advantages will be apparent from the following description, the accompanying drawings and the appended claims.

DESCRIPTION OF THE PREFERRED EMBODIMENT

Figure 1:
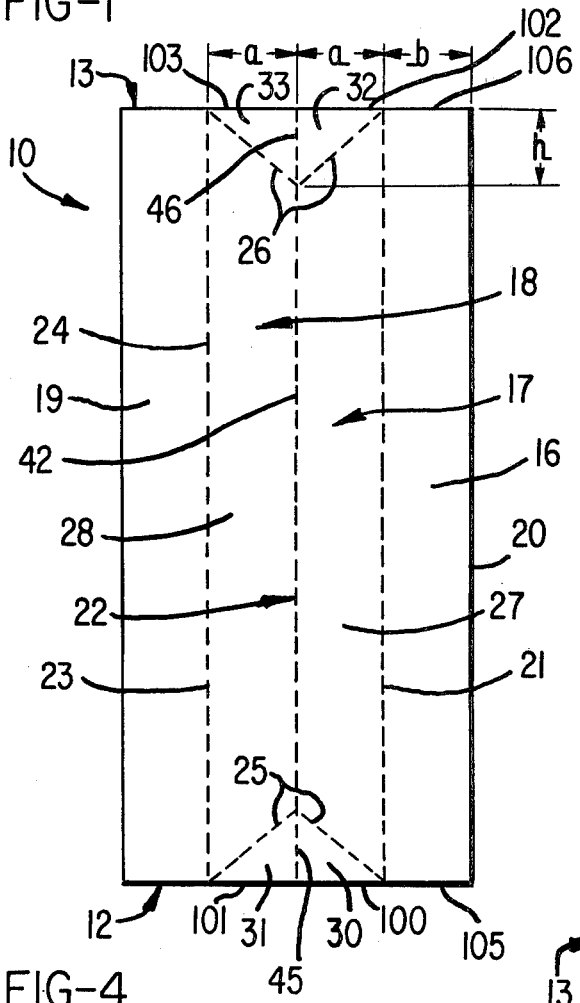
FIG. 1 is a plan view of a blank from which the container is formed.
Figure 2:
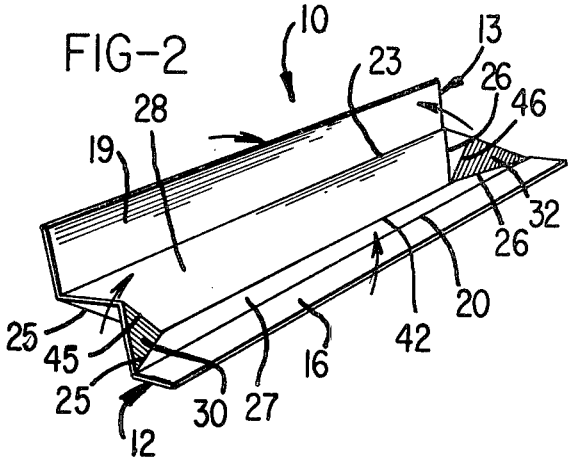
FIG. 2 is a perspective view illustrating the initial folding steps in erecting the container.
Figure 6:
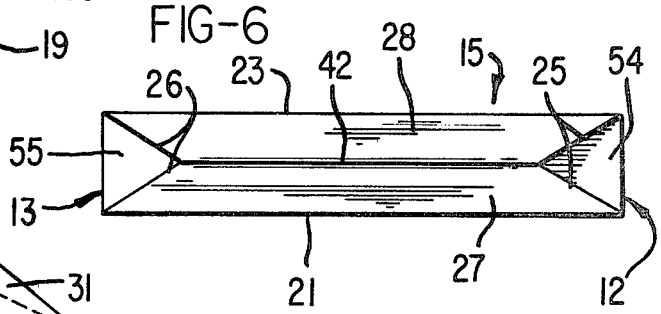
FIG. 6 is a plan view of the assembled container.

With reference to the drawings, FIG. 1 shows a blank 10 having a first end 12 at one end thereof and a second end 13 at the other end thereof. When folded and erected, blank 10 forms the container 15 shown in FIG. 6.

Blank 10 includes first, second, and third outer panels 16, 17, and 18, and a fastening flap 19. Panel 16 has a first edge 20, and is connected to panel 17 along a first fold line 21 on the side of panel 16 opposite edge 20. Panel 18 is connected to panel 17 along a second fold line 22 on the side of panel 17 opposite panel 16. Fastening flap 19 is connected to panel 18 along a third fold line 23 on the side of panel 18 opposite panel 17. Fold line 23, in this embodiment, coincides with a second edge 24 on the side of the third outer panel 18 opposite the second outer panel 17.

A first pair of chevron fold lines 25 starts at the ends of the first and third fold lines 21 and 23 at the first end 12 of blank 10 and converges toward and meets at the second fold line 22. Similarly, a second pair of chevron fold lines 26 starts at the ends of the first and third fold lines 21 and 23 at the other end 13 of blank 10, opposite chevron fold lines 25, and converges toward and meets at the second fold line 22. The chevron fold lines 25 and 26 thus divide the second and third outer panels 17 and 18 into central portions 27 and 28, respectively, a first pair of triangular end panels 30 and 31, respectively, at the first end 12, and a second pair of triangular end panels 32 and 33, respectively, at the second end 13 of blank 10. Likewise, chevron fold lines 25 and 26 divide the second fold line 22 into a central portion 42 and end segments 45 and 46, respectively. Thus triangular end panels 30 and 31 are foldably connected by chevron fold lines 25 to the remainders or central portions 27 and 28 of the second and third outer panels 17 and 18, and foldably connected to one another by segment 45 of the second fold line 22. Similarly, triangular end panels 32 and 33 are foldably connected by chevron fold lines 26 to central portions 27 and 28, and to one another by the second fold line segment 46.

Figure 3:
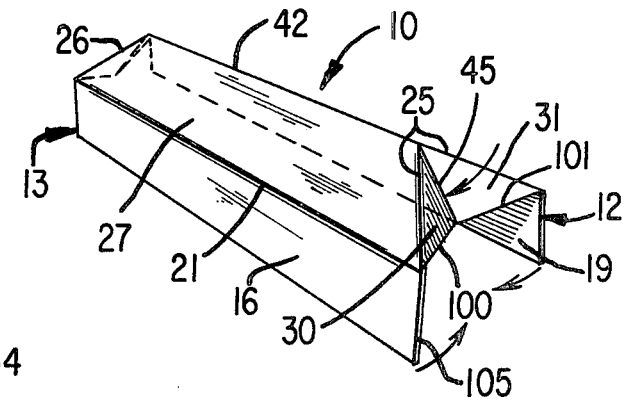
FIG. 3 is a perspective view of the FIG. 2 blank inverted and further folded.
Figure 4:
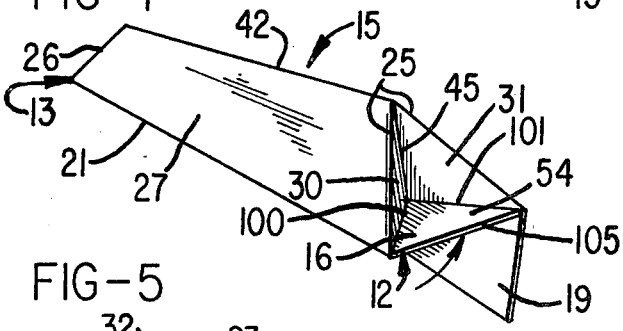
FIG. 4 shows final folding of the three main container panels.
Figure 5:
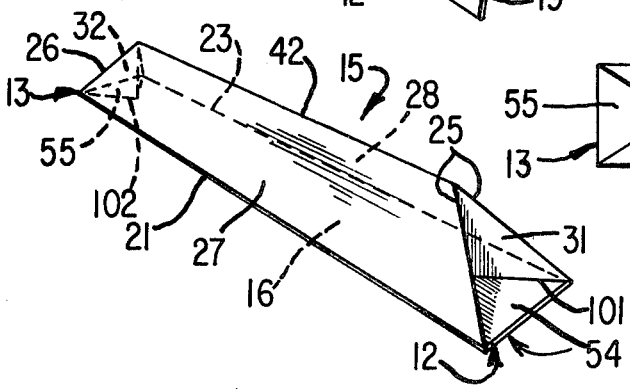
FIG. 5 illustrates the final assembly step as the fastening flap is folded and secured into position.

FIGS. 2–5 illustrate the steps in folding blank 10 to erect container 15. The triangular end panels 30–33 are first folded inwardly along the second fold line segments 45 and 46, which are folded to be outwardly concave when the container is completed. Fold lines 21 and 23, chevron fold lines 25 and 26, and the central portion 42 of fold line 22 are folded to be outwardly convex. As illustrated in FIGS. 3 and 4, the first, second, and third outer panels are then folded to give the container a triangular shape. The second and third outer panels (FIG. 3) form two sides of the triangular container, and the triangular end panels 30–33 fold inwardly to close the ends of the container 15. Next (FIG. 4) the first outer panel 16 is folded so that the first edge 20 thereof lies substantially adjacent the third outer panel second edge 23 (which in this embodiment is also the third fold line 23). The ends of the second and third outer panels 17 and 18 at the first and second ends 12 and 13, which are also sides of the triangular end panels 30–33, now lie adjacent the first outer panel 16, closing the ends of the container 15. This completes the folding of the basic container, which is now secured by folding the fastening flap 19 up beneath the first outer panel 16, as illustrated by the arrow in FIG. 5, and suitably securing the fastening flap 19 and first outer panel 16 to one another (such as by gluing or stapling).

Since the triangular container 15 was formed from a rectangular blank, there is no wasted sheet material. The straightforward and uncomplicated configuration also reduces time and labor in preparing and erecting the containers. Further, due to its geometry, the container is very strong and rigid, far more so than a rectangular package of similar sheet material. This inherent strength results in additional cost savings.

The strength of the container is enhanced by the triangular end panels 30–33. These, and the concave fold line segments 45 and 46, are perpendicular to the first outer panel 16, providing extreme resistance to crushing. Furthermore, the concave configuration of the package ends leaves bumper portions 54 and 55 of the first outer panel 16 extending beyond the triangular end panels 30, 31, 32 and 33, respectively.

Figure 7:
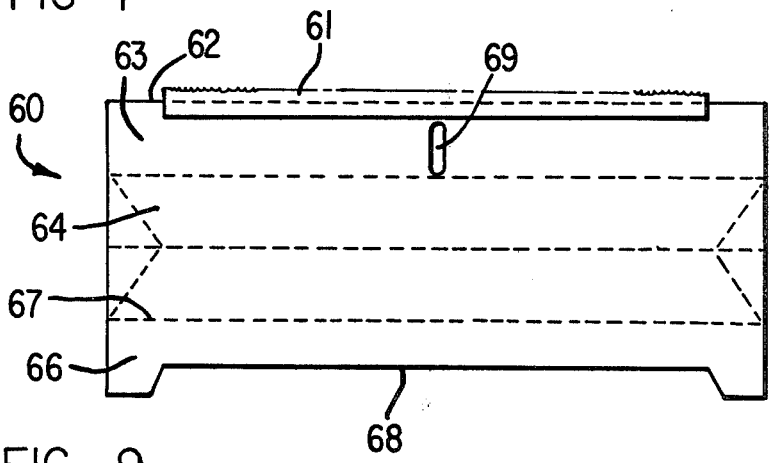
FIG. 7 is a plan view of the blank for an alternate embodiment for dispensing rolled sheet material.
Figure 8:
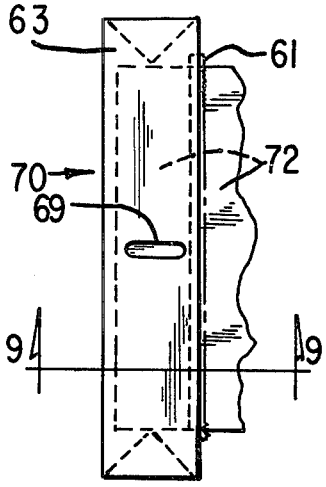
FIG. 8 is a bottom view of the container formed from the FIG. 7 blank.
Figure 10:
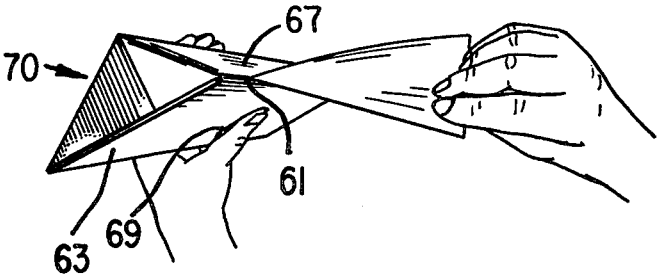
FIG. 10 is a perspective illustration of material being dispensed from the FIG. 8 container.
Figure 11:
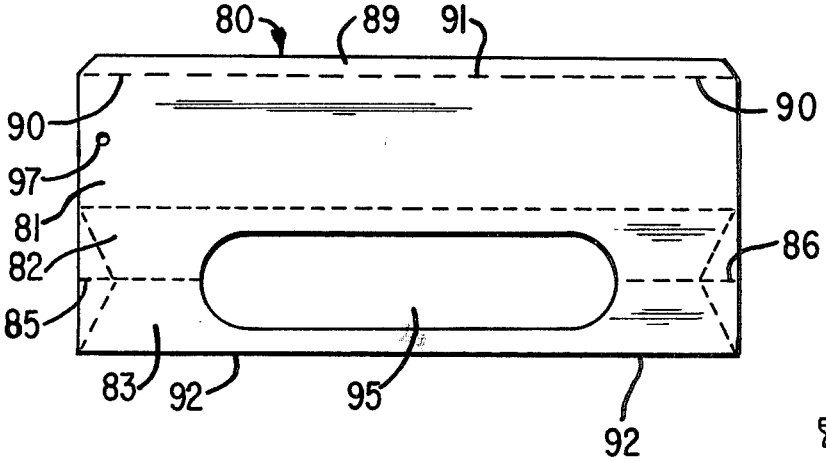
FIG. 11 is a plan view of the blank for still another embodiment.
Figure 13:
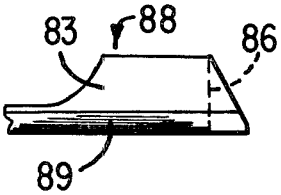
FIG. 13 is a side view of the FIG. 12 container.
Figure 12:
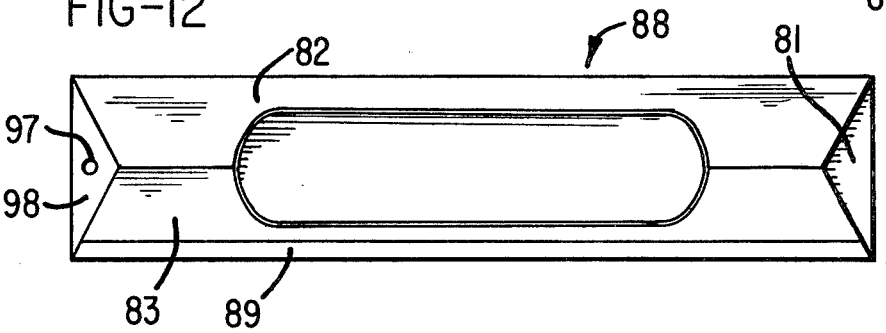
FIG. 12 is a plan view of the container formed from the blank in FIG. 11.

FIG. 7 illustrates several modifications which may be made to the basic design illustrated in FIGS. 1–6. Thus, the blank 60 in FIG. 7, which is erected in the same manner as blank 10, has a cutting edge 61 secured along the first edge 62 of the first outer panel 63, opposite the second outer panel 64. On the opposite side of the blank 60, in the side of fastening flap 66 opposite the third outer panel 67, is a recess 68. A finger slot 69 may also be provided in one of the panels, such as panel 63. The container 70 which is then formed from blank 60 is suitable for holding and dispensing rolled sheet material 72. Recess 68 allows and guides passage of the material 72 out of the container across cutting edge 61, on which the sheet material may be cut as illustrated in FIG. 10.

Figure 9:
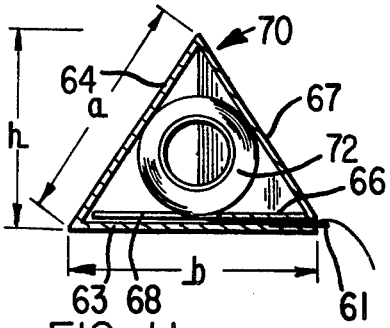
FIG. 9 is a cross-sectional view taken on line 9—9 in FIG. 8.

Containers 15 (FIGS. 1–6) and 70 (FIGS. 7–10), in cross section, are equilateral triangles (see FIG. 9). FIGS. 11–14 illustrate another embodiment which in cross section (see FIG. 14) is an isosceles triangle. In this embodiment, the blank 80 has a first outer panel 81 which is considerably wider than the second and third outer panels 82 and 83, although of the same length. In order to keep the second fold line segments 85 and 86 perpendicular to the first outer panel 81 when blank 80 is folded to erect the container 88 (FIG. 13), segments 85 and 86 have been appropriately shortened, as will be further described below.

Blank 80 and container 88 illustrate several variations in addition to the isosceles configuration. For example, although blank 80 is erected in essentially the same manner as blank 10, the fastening flap 89 is attached to the first outer panel 81 rather than the third outer panel 83 by a fold line 90 on the first outer panel first edge 91, opposite the second outer panel 82. Fastening flap 89 is also much narrower than panels 81–83, since a full overlap of the first outer panel 81 is often not necessary for securing the erected container. In fact, it is possible to eliminate the fastening flap entirely from the present invention, and to secure the first and second edges of the first and third outer panels to one another instead by some other means such as adhesive tape.

Container 88 includes additional features which make it suitable for point-of-sale display. These include a display window 95 formed by a suitable cutout in the second and third outer panels 82 and 83, and an opening 97 through the first outer panel 81 near one end thereof and within the corresponding bumper portion 98. Display window 95 thus provides for displaying the contents of the package, and opening 97 is suitable for hanging the container on a hook, such as on a display rack.

In the preferred form, the concave segments of the second folding line are perpendicular to the first outer panel in the erected container. This provides maximum strength and rigidity for the container, and eliminates wasted material since a rectangular blank can be used. Otherwise, the ends of the container might not be closed by the triangular end panels 30–33 unless the blank were modified to accommodate concave fold line segments which were not perpendicular to the first outer panel. In the preferred embodiments, therefore, there is a definite relationship among the ends of the first, second and third outer panels at the first and second ends of the blank and the lengths of the concave second fold line segments.

Figure 14:
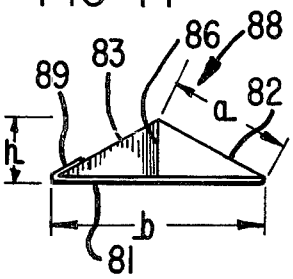
FIG. 14 is an end view of the container shown in FIGS. 12 and 13.

With reference to FIG. 1, the second and third outer panels 17 and 18, including the areas of the triangular end panels 30–33, have substantially equal dimensions. Thus the respective ends 100–103 are of the same length. For convenience in explaining these dimensional relationships, this length is designated *a* in all embodiments, as shown in FIGS. 1, 9, and 14. The ends 105 and 106 of the first outer panel 16 may be of either the same length a, in which case all three outer panels have substantially equal dimensions, or may be of a different length b, in which case the first outer panel will have dimensions different from those of the second and third outer panels. For purposes of further explanation, the ends of the first outer panel will be designated as having length b, regardless of whether a and b are equal or unequal.

Referring to FIGS. 9 and 15, it will be seen that the triangular cross section of the assembled container has a base b (formed by the first outer panel) and upper sides a (formed by the second and third outer panels). In FIG. 14, the triangle is isosceles, and in FIGS. 5 and 9 equilateral (which is a particular form of isosceles triangle). The height of the triangles is designated by h, and is the length of the concave segments (45 and 46 in FIG. 1) of the second fold line. These dimensions are related by the well-known Pythagorean theorum as follows:

$$h=\tfrac{1}{2}\sqrt{4a^2-b^2} \quad (1)$$

$$a=\tfrac{1}{2}\sqrt{4h^2+b^2} \quad (2)$$

Therefore, knowing the sizes of the outer panels, equation (1) specifies the exact length of the end or concave segments of the second fold line. The chevron fold lines are then completed by drawing diagonally from the second fold line segments to the ends of the first and third fold lines. Conversely, if one knows how tall the package is to be (h) and how large the base (b), equation (2) specifies the length of the ends of the second and third panels (a).

To illustrate, the following table presents representative dimensions. Length a has been set at unity, and proportionate lengths b and h are provided:

| a | b | h |
|---|---|---|
| 1.00 | .25 | .99 |
| 1.00 | .50 | .97 |
| 1.00 | .75 | .93 |
| 1.00 | 1.00 | .87 |
| 1.00 | 1.25 | .78 |
| 1.00 | 1.50 | .66 |
| 1.00 | 1.75 | .48 |

The embodiments in FIGS. 1–6 and 7–10 are equilateral, in which a=b=1.00, and h=0.87. (The chevron fold lines 25 and 26, incidentally, have length 1.32.) In the isosceles embodiment in FIGS. 11–14, a=1.00, b=1.75, and h=0.48. (Also, the chevron fold lines equal 1.11).

As may be seen, therefore, the present invention has numerous advantages. It provides a strong and rigid container which can be sized and shaped to protect flowers, axes, toothpaste tubes, artillery shells, toy dolls, and so forth, almost without limit. It is formed from a rectangular blank so that there is no material waste. It is quick and easy to erect, minimizing labor costs. It may be modified, as by the addition of a display window, to serve a variety of end uses, for even greater economy. In addition, the extreme rigidity of the package, and the additional protection provided by the end bumpers, mean that lighter weight board or sheet material may be used, at further cost savings, than for a comparable rectangular container.

While the forms of apparatus herein described constitute preferred embodiments of this invention, it is to be understood that the invention is not limited thereto, and that changes may be made therein without departing from the scope of the invention.

What is claimed is:

1. A blank for forming a container of triangular section, comprising:

(a) a rectangular first outer panel free of fold lines and having a first side edge, (b) a second outer panel connected to said first outer panel along a first fold line on the side of said first outer panel opposite said first side edge, (c) a third outer panel connected to said second outer panel along a second fold line on the side of said second outer panel opposite said first outer panel, and having a second side edge on the side of said third outer panel opposite said second outer panel, (d) neither of said second and third outer panels extending beyond said first panel at either end, (e) a first pair of chevron fold lines starting at the ends of said first fold line and said second side edge at one end of said blank and converging toward and meeting at said second fold line to define a first pair of triangular end panels formed from portions of said second and third outer panels at said one end of said blank, said triangular end panels being foldably connected by said chevron fold lines to the remainders of said second and third outer panels, and foldably connected to one another along the segment of said second fold line between said one end of said blank and the intersection of said second fold line with said chevron fold lines, and (f) a second pair of chevron fold lines starting at the ends of said first fold line and said second side edge at the other end of said blank opposite said one end, said second pair of chevron fold lines converging toward and meeting at said second fold line to define a second pair of triangular end panels formed from portions of said second and third outer panels at said other end of said blank, said second pair of triangular end panels being foldably connected by said second pair of chevron fold lines to the remainders of said second and third outer panels, and foldably connected to one another along the segment of said second fold line between said other end of said blank and the intersection of said second fold line with said second pair of chevron fold lines, (g) said panels and fold lines being proportioned and spaced whereby, upon folding of said blank along said fold lines with said first side edge of said first outer panel substantially engaging said second edge of said third panel, said panels define a container of triangular section with said triangular end panels closing the opposite ends thereof and the end edges thereof seated on said first panel.

2. The structure of claim 1 wherein each of said triangular end panels includes a right angle defined by the exposed edge thereof and said second fold line.

3. The structure of claim 1 further comprising fastening means for fastening said first outer panel first edge substantially adjacent said third outer panel second edge when said blank is erected to form said container.

4. A triangular container, comprising:

(a) a first outer panel having a first edge, (b) a second outer panel connected to said first outer panel along an outwardly convex first fold line on the side of said first outer panel opposite said first edge, (c) a third outer panel connected to said second outer panel along a second fold line on the side of said second outer panel opposite said first outer panel, said second fold line being outwardly convex along at least a central portion thereof, and said third outer panel having a second edge on the side thereof opposite said second outer panel, (d) fastening means fastening said first outer panel first edge substantially adjacent said third outer panel second edge, (e) a first pair of triangular end panels at one end of said container formed from portions of said second and third outer panels, respectively, said triangular end panels being folded to close said container at said one end thereof along a first pair of outwardly convex chevron fold lines starting at the ends of said first fold line and said second edge at said one end of said container and converging toward and meeting at said second fold line, the segment of said second fold line between said one end of said container and the intersection of said second fold line with said chevron fold lines being outwardly concave and connecting said triangular end panels to one another, the ends of said second and third outer panels, which are also sides of said triangular end panels, lying adjacent said first outer panel to close said one end of said container, and (f) a second pair of triangular end panels at the other end of said container opposite said one end and formed from portions of said second and third outer panels, respectively, said second pair of triangular end panels being folded to close said container at said other end thereof along a second pair of outwardly convex chevron fold lines starting at the ends of said first fold line and said second edge at said other end of said container and converging toward and meeting at said second fold line, the segment of said second fold line between said other end of said container and the intersection of said second fold line with said second pair of chevron fold lines being outwardly concave and connecting said second pair of triangular panels to one another, the ends of said second and third outer panels at said other end of said container, which are also sides of said second pair of triangular end panels, lying adjacent said first outer panel to close said other end of said container.

5. The structure of claim 1, 3 or 4 wherein one of said first and third panels has an exposed edge, and further comprising cutting means secured along said exposed edge.

6. The structure of claim 3 or 4 wherein one of said first and third panels has an exposed edge, further comprising cutting means secured along said exposed edge, and said fastening means comprising flap means secured to the other of said first and third panels by a fold line.

7. The structure of claim 6 further comprising means defining a recess in said flap means for receiving and guiding sheet material from a roll within said container out of said container past said cutting means.

8. The structure of claim 3 or 4 wherein said fastening means further comprises a fastening flap connected to said third outer panel by a third fold line on said third outer panel second edge.

9. The structure of claim 3 or 4 wherein said fastening means further comprises a fastening flap connected to said first outer panel by a third fold line on said first outer panel first edge.

10. The structure of claim 1 or 4 wherein said second and third outer panels, including the areas of said triangular end panels, have substantially equal dimensions.

11. The structure of claim 10 wherein said first outer panel has dimensions different from those of said second and third outer panels.

12. The structure of claim 10 wherein said first, second, and third outer panels have substantially equal dimensions.

13. The structure of claim 1 or 4 wherein said segments of said second fold line each have a length equal to the height of a triangle having a base equal in length to the end of said first outer panel at said one end of said structure and sides equal in length to the ends of said second and third outer panels at said one end of said structure.

14. The structure of claim 1 or 4 further comprising means forming an opening through said first outer panel near one end thereof.

15. The structure of claim 1 or 4 further comprising means forming a display window in at least one of said outer panels.

16. The structure of claim 1 or 4 further comprising means forming a finger slot in one of said outer panels.

17. A rectangular blank for forming a container, comprising:

(a) a first rectangular outer panel, (b) a second rectangular outer panel having the same dimensions as said first outer panel and connected to said first outer panel along a first fold line, (c) a third rectangular outer panel having the same dimensions as said first and second outer panels and connected to said second outer panel along a second fold line on the side of said second outer panel opposite said first outer panel, (d) a fastening flap connected to said third outer panel along a third fold line on the side of said third outer panel opposite said second outer panel, (e) a first pair of chevron fold lines starting at the ends of said first and third fold lines at one end of said blank and converging toward and meeting at said second fold line to define a first pair of triangular end panels formed from portions of said second and third outer panels at said one end of said blank, said triangular end panels being foldably connected by said chevron fold lines to the remainders of said second and third outer panels, and foldably connected to one another along a first segment of said second fold line between said one end of said blank and the intersection of said second fold line with said chevron fold lines, said first segment of said second fold line having a length which is substantially 0.87 as long as the length of each of the ends of said outer panels at said one end of said blank, and (f) a second pair of chevron fold lines starting at the ends of said first and third fold lines at the other end of said blank opposite said one end, said second pair of chevron fold lines converging toward and meeting at said second fold line to define a second pair of triangular end panels formed from portions of said second and third outer panels at said other end of said blank, said second pair of triangular end panels being foldably connected by said second pair of chevron fold lines to the remainders of said second and third outer panels, and foldably connected to one another along a second segment of said second fold line between said other end of said blank and the intersection of said second fold line with said second pair of chevron fold lines, said second segment having the same length as said first segment.

18. A triangular container, comprising:

(a) a first rectangular outer panel, (b) a second rectangular outer panel having the same dimensions as said first outer panel and connected to said first outer panel along an outwardly convex first fold line, (c) a third rectangular outer panel having the same dimensions as said first and second outer panels and connected to said second outer panel along a second fold line on the side of said second outer panel opposite said first outer panel, said second fold line being outwardly convex along at least a central portion thereof, (d) a fastening flap connected to said third outer panel along an outwardly convex third fold line on the side of said third outer panel opposite said second outer panel, said fastening flap being fastened to said first outer panel with the side of said first outer panel opposite said first fold line lying substantially adjacent said third fold line, (e) a first pair of triangular end panels at one end of said container formed from portions of said second and third outer panels, respectively, said triangular end panels being folded to close said container at said one end thereof along a first pair of outwardly convex chevron fold lines starting at the ends of said first and third fold lines at said one end of said container and converging toward and meeting at said second fold line, a first segment of said second fold line between said one end of said container and the intersection of said second fold line with said chevron fold lines being outwardly concave and connecting said triangular end panels to one another, said first segment of said second fold line being perpendicular to said first outer panel and having a length which is substantially 0.87 as long as the length of each of the ends of said outer panels at said one end of said container, the ends of said second and third outer panels, which are also sides of said triangular end panels, substantially engaging said first outer panel to close said one end of said container, and (f) a second pair of triangular end panels at the other end of said container opposite said one end and formed from portions of said second and third outer panels, respectively, said second pair of triangular end panels being folded to close said container at said other end thereof along a second pair of outwardly convex chevron fold lines starting at the ends of said first and third fold lines at said other end of said container and converging toward and meeting at said second fold line, a second segment of said second fold line between said other end of said container and the intersection of said second fold line with said second pair of chevron fold lines being outwardly concave and connecting said second pair of triangular panels to one another, said second segment being perpendicular to said first outer panel and having the same length as said first segment, and the ends of said second and third outer panels at said other end of said container, which are also sides of said second pair of triangular end panels, substantially engaging said first outer panel to close said other end of said container.

* * * * *